US011164513B2

(12) United States Patent
Suo et al.

(10) Patent No.: US 11,164,513 B2
(45) Date of Patent: Nov. 2, 2021

(54) DRIVING METHOD AND DRIVING CHIP FOR ORGANIC LIGHT-EMITTING DISPLAY PANEL BASED ON GAMMA CURVE, AND DISPLAY DEVICE

(71) Applicant: WUHAN TIANMA MICRO-ELECTRONICS CO., LTD., Wuhan (CN)

(72) Inventors: Lei Suo, Wuhan (CN); Bojia Lv, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 16/264,703

(22) Filed: Feb. 1, 2019

(65) Prior Publication Data

US 2019/0164474 A1 May 30, 2019

(30) Foreign Application Priority Data

Sep. 27, 2018 (CN) ..... 201811130640.9

(51) Int. Cl.
*G09G 3/3208* (2016.01)
*G09G 3/3233* (2016.01)

(52) U.S. Cl.
CPC ..... *G09G 3/3208* (2013.01); *G09G 3/3233* (2013.01); *G09G 2320/064* (2013.01); *G09G 2320/0673* (2013.01)

(58) Field of Classification Search
CPC ..... G09G 3/3208; G09G 3/3233; G09G 2320/0673; G09G 2320/064; G09G 2320/0276
See application file for complete search history.

(56) References Cited

U.S. PATENT DOCUMENTS

2005/0168490 A1* 8/2005 Takahara ..... G09G 3/325 345/690
2008/0143757 A1* 6/2008 Furihata ..... G09G 3/3406 345/690

(Continued)

FOREIGN PATENT DOCUMENTS

CN 101465096 A 6/2009
CN 104599637 A 5/2015

OTHER PUBLICATIONS

Office Action of Chinese Patent Application No. 201811130640.9 dated Dec. 2, 2019.

*Primary Examiner* — Ryan A Lubit
(74) *Attorney, Agent, or Firm* — Kilpatrick Townsend & Stockton, LLP

(57) ABSTRACT

A driving method and a driving chip for an organic light-emitting display panel, and a display device are provided. The method includes: acquiring a target brightness; determining a rank corresponding to the target brightness, each rank including a first brightness range, and the first brightness ranges being different and having no overlapping, the first brightness range including the target brightness, and each rank having a Gamma curve corresponding to a maximum brightness of the first brightness range in the rank, determining, in the rank, a duty ratio corresponding to the target brightness, the duty ratio being an effective pulse duty ratio of a light-emitting control signal, and the maximum brightness of the first brightness range in each rank corresponding to a same duty ratio; and driving the organic light-emitting display panel based on the Gamma curve and the duty ratio corresponding to the target brightness in the rank.

13 Claims, 4 Drawing Sheets

(56) References Cited

U.S. PATENT DOCUMENTS

| | | | | |
|---|---|---|---|---|
| 2008/0150850 | A1* | 6/2008 | Park | G09G 3/2003 345/83 |
| 2010/0164922 | A1* | 7/2010 | Nose | H05B 45/12 345/207 |
| 2019/0053342 | A1* | 2/2019 | Shih | H05B 45/10 |

* cited by examiner

DRIVING METHOD AND DRIVING CHIP FOR ORGANIC LIGHT-EMITTING DISPLAY PANEL BASED ON GAMMA CURVE, AND DISPLAY DEVICE

CROSS-REFERENCE TO RELATED APPLICATIONS

The present application claims priority to Chinese Patent Application No. 201811130640.9, filed on Sep. 27, 2018, the content of which is incorporated herein by reference in its entirety.

FIELD

The present disclosure relates to the field of display technologies, and in particular, to a driving method for an organic light-emitting display panel, a driving chip for an organic light-emitting display panel, and a display device.

BACKGROUND

At present, display technologies have been applied to every aspect of people's daily life, and accordingly, more and more materials and technologies have been used for display screens. Today, display screens mainly include liquid crystal display panels and organic light-emitting display panels. The organic light-emitting display panel has more and more applications due to its high color saturation, high brightness, high contrast, fast response, and small thickness and the like. In order to make the displayed image to be better adapted to human visual feelings, it is necessary to correct the image according to Gamma curve.

However, the Gamma curve is a curve within a specific brightness range. After adjusting brightness of an organic light-emitting display panel, the displayed image will deviate from a preset Gamma curve, resulting in poor brightness adjustment.

SUMMARY

The present disclosure provides a driving method for an organic light-emitting display panel, a driving chip for an organic light-emitting display panel, and a display device, for improving the brightness adjustment.

In one embodiment, the present provides a driving method for an organic light-emitting display panel, and the driving method includes: acquiring a target brightness; determining a rank, from a plurality of ranks, corresponding to the target brightness, and each of the plurality of ranks includes a first brightness range, and the first brightness ranges of any two ranks of the plurality of ranks are different from each other and have no overlapping, the first brightness range of the rank corresponding to the target brightness includes the target brightness, and each of the plurality of ranks has a Gamma curve corresponding to a maximum brightness of the first brightness range of the rank, determining, in the rank corresponding to the target brightness, a duty ratio corresponding to the target brightness, and the duty ratio is an effective pulse duty ratio of a light-emitting control signal, and the maximum brightness of the first brightness range of each of the plurality of ranks corresponds to a same duty ratio; and driving the organic light-emitting display panel based on the Gamma curve of the rank corresponding to the target brightness and the duty ratio corresponding to the target brightness in the rank corresponding to the target brightness.

In another embodiment, the present disclosure provides a driving chip, and the driving chip includes: a target brightness acquiring device configured to acquire a target brightness; a rank determining device configured to determine a rank corresponding to the target brightness from a plurality of ranks, and each of the plurality of ranks includes a first brightness range, the first brightness ranges of any two ranks of the plurality of ranks are different from each other and have no overlapping, the first brightness range of the rank corresponding to the target brightness includes the target brightness, each of the plurality of ranks has a Gamma curve corresponding to a maximum brightness of the first brightness range of the rank; a duty ratio determining device configured to determine a duty ratio corresponding to the target brightness in the rank corresponding to the target brightness, and the duty ratio is an effective pulse duty ratio of a light-emitting control signal, and the maximum brightness of the first brightness range in each of the plurality of ranks corresponds to a same duty ratio; and a driving device configured to drive the organic light-emitting display panel based on the Gamma curve of the rank corresponding to the target brightness and the duty ratio corresponding to the target brightness in the rank corresponding to the target brightness.

In still another embodiment, the present disclosure provides a display device, and the display device includes a light-emitting display panel and any of the driving chips disclosed in the present disclosure.

BRIEF DESCRIPTION OF DRAWINGS

Embodiments of the present disclosure or in the related art, the accompanying drawings used in the embodiments and in the related art are briefly introduced as follows.

DESCRIPTION OF EMBODIMENTS

The embodiments of the present disclosure are described in the following with reference to the accompanying drawings. It should be understood that the described embodiments are merely exemplary embodiments of the present disclosure, which shall not be interpreted as providing limitations to the present disclosure.

The terms used in the embodiments of the present disclosure are merely for the purpose of describing particular embodiments but not intended to limit the present disclosure. Unless otherwise noted in the context, the singular form expressions "a", "an", "the" and "said" used in the embodiments and appended claims of the present disclosure are also intended to represent plural form expressions thereof.

Figure 1:
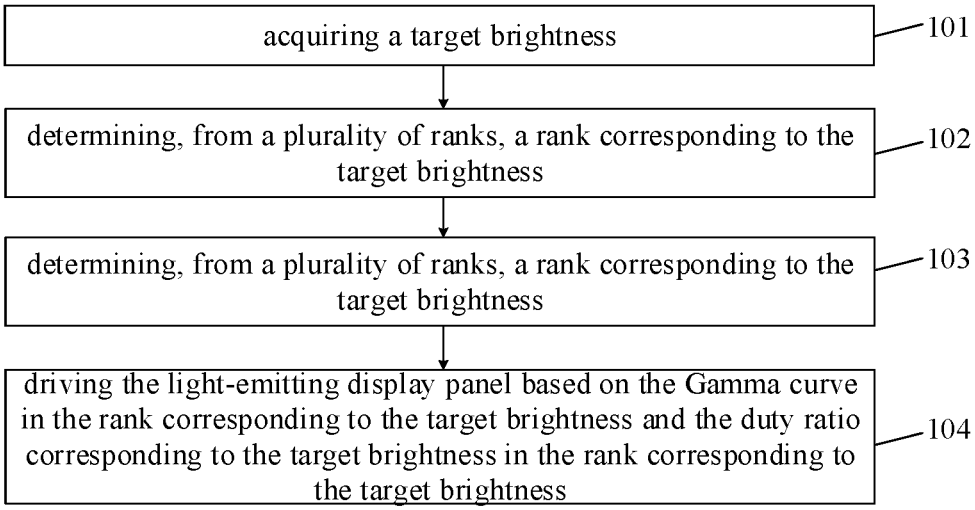
FIG. 1 is a flowchart of a driving method for an organic light-emitting display panel according to an embodiment of the present disclosure.

FIG. 1 is a flowchart of a driving method for an organic light-emitting display panel according to an embodiment of the present disclosure. As shown in FIG. 1, an embodiment of the present disclosure provides a driving method for an organic light-emitting display panel, and the driving method includes following steps.

Step 101: a target brightness is acquired.

In one embodiment, the target brightness is a maximum brightness of the display panel that a user can reach by adjustment. For example, a maximum brightness range of the display panel is 0-600 nits, that is, the maximum brightness that the display panel can display is 600 nits and the minimum brightness that the display panel can display is 0 nits. For example, if the user adjusts the brightness of the displayed image of the display panel within a range of 0-600 nits, the target brightness is 600 nits; if the user adjusts the brightness of the displayed image of the display panel within a range of 0-300 nits, the target brightness is 300 nits.

Step 102: a rank corresponding to the target brightness is determined from a plurality of ranks, each rank includes a respective first brightness range, the first brightness ranges of any two ranks are different from each other and have no overlapping, the first brightness range in the rank corresponding to the target brightness includes the target brightness, and each rank has a Gamma curve corresponding to the maximum brightness of the first brightness range in this rank.

Figure 2:
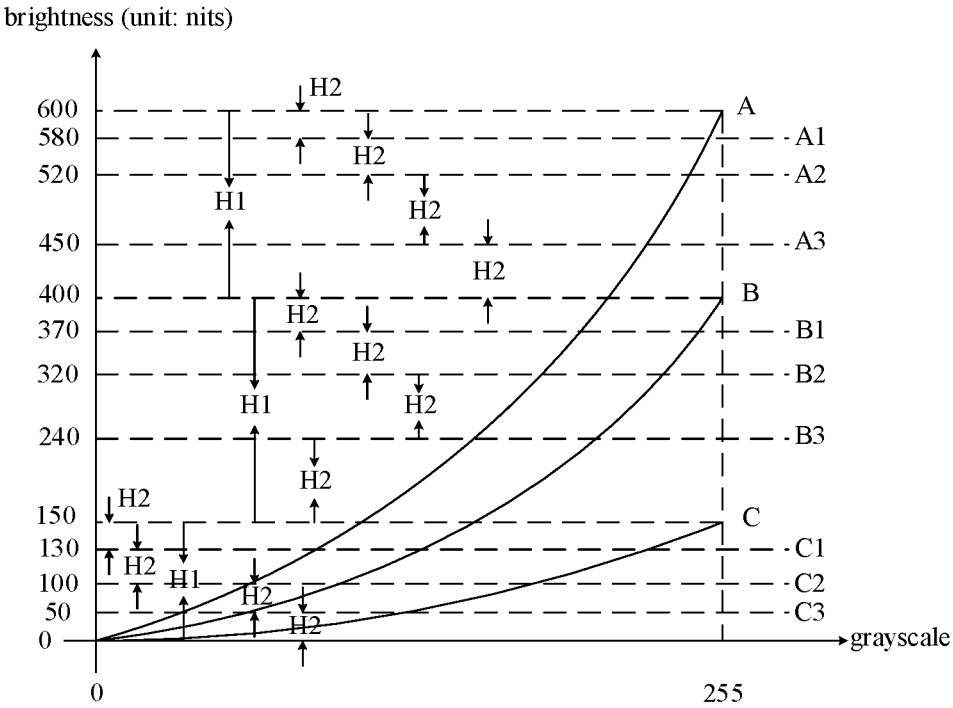
FIG. 2 is a schematic diagram illustrating respective Gamma curves of different ranks according to an embodiment of the present disclosure.

In one embodiment, for example, as shown in FIG. 2, which is a schematic diagram illustrating respective Gamma curves of different ranks according to an embodiment of the present disclosure, the maximum brightness range of the display panel is 0-600 nits, and this brightness range has three ranks: a first rank of 0-600 nits, a second rank of 0-400 nits, and a third rank of 0-150 nits. The first brightness range H1 of the first rank is (400, 600], the first brightness range H1 of the second rank is (150, 400], and the first brightness range H1 of the third rank is (0, 150]. The first rank corresponds to a Gamma curve A, and the Gamma curve A is a Gamma curve corresponding to 600 nits, that is, the Gamma curve A represents a Gamma curve with a maximum grayscale value of 255 and a brightness of 600 nits. The second rank corresponds to a Gamma curve B, and the Gamma curve B is a Gamma curve corresponding to 400 nits, that is, the Gamma Curve B represents a Gamma curve with a maximum grayscale value of 255 and a brightness of 400 nits. The third rank corresponds to a Gamma curve C, and the Gamma curve C is a Gamma curve corresponding to 150 nits, that is, the Gamma curve C represents a maximum grayscale value of 255 and a brightness of 150 nits. It should be noted that FIG. 2 merely illustrates Gamma curves corresponding to one color, and different colors correspond to different Gamma curves. The driving method provided by the embodiment of the present disclosure is described herein by taking sub-pixels with only one color as an example, however, the driving method is also applied to sub-pixels with different colors, and the only difference lies in that the sub-pixel with different colors corresponds to different Gamma curves. For example, if the target brightness acquired at step 101 is 520 nits, then at step 102, only the first brightness range H1 of (400,600] includes 520 nits, so the rank corresponding to the target brightness of 520 nits is determined to be the first rank, i.e., 0-600 nits; if the target brightness acquired at step 101 is 240 nits, then at step 102, only the first brightness range H1 of (150,400] includes 240 nits, so the rank corresponding to the target brightness of 240 nits is determined to be the second rank, i.e., 0-400 nits.

Step 103: in the rank corresponding to the target brightness, a duty ratio corresponding to the target brightness is determined, and the duty ratio is an effective pulse duty ratio of a light-emitting control signal, and the maximum brightness of the first brightness range in each rank corresponds to a same duty ratio;

In one embodiment, the light-emitting control signal is used to control whether the light-emitting device corresponding to the sub-pixels emits light or not. The larger the duty ratio is, the longer the light emission time of the light-emitting device is, and the higher the brightness is; otherwise, the smaller the duty ratio is, the shorter the light emission time of the light-emitting device is, and the lower the brightness is. When the duty ratio is 100%, it means that the light-emitting device has the largest light emission time. The correlation between the brightness and the duty ratio in each rank is set in advance, and the maximum brightness of the first brightness range in each rank corresponds to a same duty ratio. A possible setting manner is that, the duty ratio is adjusted from 100% to 0% according to data voltage values based on the maximum brightness of different Gamma curves, and the correlation between the brightness and the duty ratio is recorded. For example, a data voltage value is determined based on the maximum brightness of the Gamma curve A, and the brightness where the duty ratio is 100% is the maximum brightness 600 nits of the first brightness range H1 of the first rank; next, the duty ratio is adjusted to 80%, and the brightness at this time is detected, which is, for example, 580 nits, and then 580 nits is a first node A1 of the first rank; next, the duty ratio is adjusted to 60%, and the brightness at this time is detected, which is, for example, 520 nits, and then 520 nits is a second node A2 of the first rank; next, the duty ratio is adjusted to 40%, and the brightness at this time is detected, which is, for example, 450 nits, and then 450 nits is a third node A3 of the first rank; next, the duty ratio is adjusted to 20%, and the brightness at this time is detected, which is, for example, 400 nits. A data voltage value is determined based on the maximum brightness of the Gamma curve B, and the brightness where the duty ratio is 100% is the maximum brightness 400 nits of the first brightness range H1 of the second rank; next, the duty ratio is adjusted to 80%, and the brightness at this time is detected, which is, for example, 370 nits, and then 370 nits is a first node B1 of the second rank; next, the duty ratio is adjusted to 60%, and the brightness at this time is detected, which is, for example, 320 nits, and then 320 nits is a second node B2 of the second rank; next, the duty ratio is adjusted to 40%, and the brightness at this time is detected, which is, for example, 240 nits, and then 240 nits is a third node B3 of the second rank; next, the duty ratio is adjusted to 20%, and the brightness at this time is detected, which is, for example, 150 nits. A data voltage value is determined based on the maximum brightness of the Gamma curve C, and the brightness where the duty ratio is 100% is the maximum brightness 150 nits of the first brightness range H1 of the third rank; next, the duty ratio is adjusted to 80%, and the brightness at this time is detected, which is, for example, 130 nits, and then 130 nits is a first node C1 of the third rank; next, the duty ratio is adjusted to 60%, and the brightness at this time is detected, which is, for example, 100 nits, and then 100 nits is a second node C2 of the third rank; next, the duty ratio is adjusted to 40%, and the brightness at this time is detected, which is, for example, 50 nits, and then 50 nits is a third node C3 of the third rank. For example, if the target brightness acquired at step 101 is 520 nits, then it corresponds to the first rank. Based on the Gamma curve A in the first rank, the duty ratio corresponding to 520 nits is 60%, so the duty ratio corresponding to the target brightness is determined to be 60%. If the target brightness acquired at step 101 is 240 nits, then it corresponds to the second rank. Based on the Gamma curve B in the second rank, the duty ratio corresponding to 240 nits is 40%, so the duty ratio corresponding to the target brightness is determined to be 40%. Moreover, assuming that the target brightness is 400 nits, and the corresponding duty ratio of 400 nits of the first rank is 20% while the corresponding duty ratio of 400 nits of the second rank is 100%, in this case, since 400 nits does not belong to the range (400, 600] and belongs to the range (150,400], 400 nits does not belong to the first rank and belongs to the second rank, and it should correspond to the Gamma curve B in the second rank and the duty ratio of 100%.

Step 104: an organic light-emitting display panel is driven based on the Gamma curve in the rank corresponding to the target brightness and the duty ratio corresponding to the target brightness in the rank corresponding to the target brightness.

In one embodiment, assuming that the target brightness is 520 nits, then the organic light-emitting display panel is driven based on the Gamma curve A and the duty ratio of 60%; assuming that the target brightness is 240 nits, then the organic light-emitting display panel is driven based on the Gamma curve B and the duty ratio of 40%.

Figure 3:
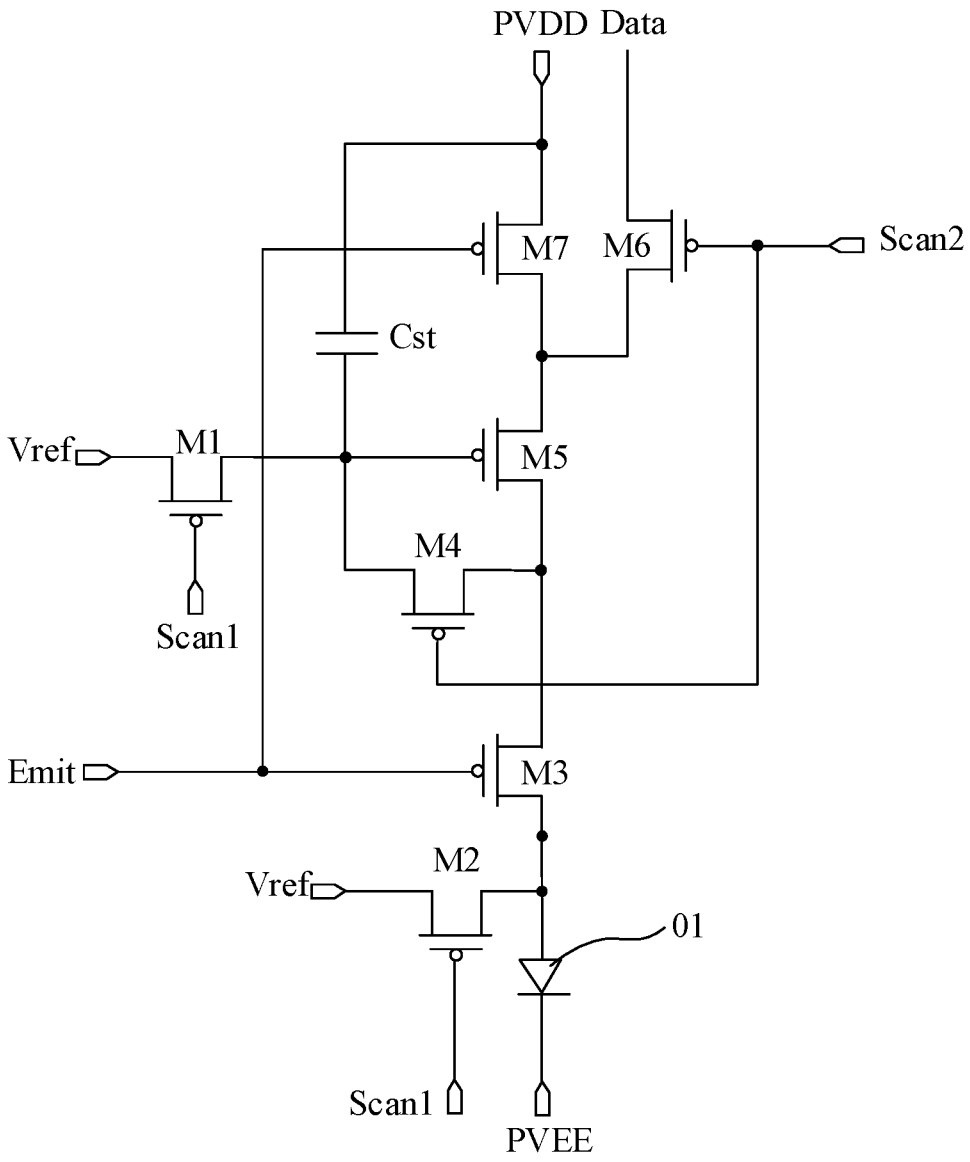
FIG. 3 is a schematic structural diagram of a pixel driving circuit according to an embodiment of the present disclosure.
Figure 4:
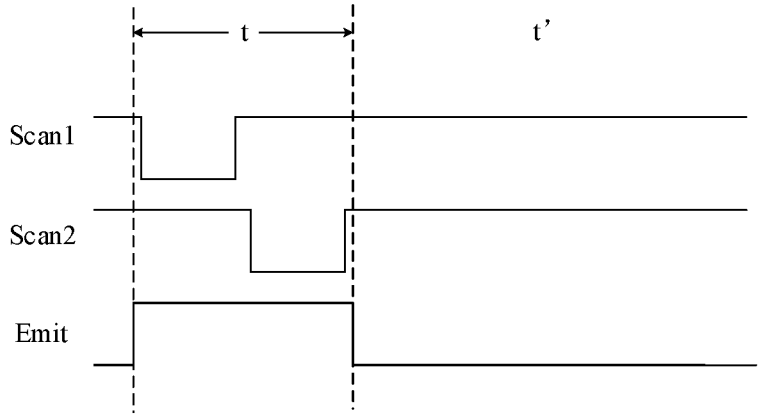
FIG. 4 is a timing signal diagram of the pixel driving circuit of FIG. 3.

FIG. 3 is a schematic structural diagram of a pixel driving circuit according to an embodiment of the present disclosure, and FIG. 4 is a timing signal diagram of the pixel driving circuit of FIG. 3. It should be noted that, as shown in FIG. 3 and FIG. 4, the organic light-emitting display panel includes a plurality of sub-pixels, and each sub-pixel corresponds to a pixel driving circuit. The pixel driving circuit includes an organic light-emitting device 01, and the light-emitting device 01 is configured to implement color display corresponding to the sub-pixel. The pixel driving circuit includes first to seventh transistors, i.e., M1 to M7. Here, the fifth transistor M5 is a driving transistor, and the other transistors are all switching transistors. The first transistor M1 and the second transistor M2 each have a control terminal electrically connected to a first scan signal terminal Scan1. The third transistor M3 and the seventh transistor M7 each have a control terminal electrically connected to the light-emitting control signal terminal Emit. The sixth transistor M6 has a control terminal electrically connected to a second scan signal terminal Scan2. For each sub-pixel, each frame of driving time includes a charging phase t and a non-charging phase t'. Here, the charging phase t refers to a charging phase during which a potential of a control terminal of the fifth transistor M5 has a correlation with a data voltage transmitted by a data signal line Data under the action of the first scan signal terminal Scan1, the second scan signal terminal Scan2, a reference voltage signal terminal Vref, and the data signal line Data, and the fifth transistor M5 generates a corresponding driving current by the control of the data voltage. During the charging phase t, the light-emitting control signal terminal Emit needs to output a non-enable level (for example, a high level as a non-enable level) to control the third transistor M3 and the seventh transistor M7 to be turned off, so that it is in an off-state between a first power supply voltage terminal PVDD and a second power supply voltage terminal PVEE during the charging phase t, and no current will pass through the light-emitting device 01, that is, the light-emitting device 01 does not emit light. During the non-charging phase t', since charging has been completed and the potential of the control terminal of the fifth transistor M5 can be kept constant under the action of a storage capacitor Cst, theoretically, the light-emitting control signal terminal Emit can always output an enable level during the non-charging phase t'. At this time, the light-emitting device 01 has a maximum brightness, that is, an effective pulse duty ratio of the light-emitting control signal is 100%. During the non-charging phase t', if the light-emitting control signal terminal Emit outputs a non-enable level and the light-emitting device 01 is controlled not to emit light, i.e., the effective pulse duty ratio of the light-emitting control signal becomes smaller.

In addition, it should be noted that in the organic light-emitting display panel, under a same duty ratio, the brightness of the sub-pixel is determined by the data voltage value. For example, in FIG. 2, three Gamma curves each with a duty ratio of 100% are illustrated, and the respective maximum grayscale values of the three Gamma curves correspond to different brightness values, that is, the three Gamma curves have different correlations between respective grayscale values and respective data voltage values. For example, for the Gamma curve A, the grayscale value 255 corresponds to a brightness of 600 nits and a data voltage value of 5V; for the Gamma curve B, the grayscale value 255 corresponds to a brightness of 400 and a data voltage value of 4.2V. Therefore, under a same duty ratio, driving the display panel by using different Gamma curves means changing the brightness of the display panel by changing the data voltage value.

In an embodiment of the present disclosure, the driving method for the organic light-emitting display panel is driven based on the Gamma curve in the rank corresponding to the target brightness. That is, based on the target brightness, different Gamma curves are selected during a wide range of brightness adjustment, and the brightness is adjusted by adjusting a corresponding data voltage value, and then the brightness is finely adjusted by adjusting the duty ratio within a small range of variation based on the selected Gamma curve. On the one hand, the image can be closer to the Gamma curve when the brightness is adjusted within a large range of variation; and on the other hand, the brightness is finely adjusted by adjusting the duty ratio based on the selected Gamma curve, so that the transition effect of brightness adjustment between different Gamma curves can be improved.

In an embodiment, at the abovementioned step 103, determining a duty ratio corresponding to the target brightness in the rank corresponding to the target brightness is: determining, according to the preset correlation between the duty ratio and the brightness, a duty ratio corresponding to the target brightness in the rank corresponding to the target brightness.

The preset correlation between the duty ratio and the brightness may be a one-to-one correspondence in an array.

TABLE 1

| | brightness (unit: nits) | duty ratio |
|---|---|---|
| first rank, Gamma curve A | 600 | 100% |
| | 580 | 80% |
| | 520 | 60% |
| | 450 | 40% |
| second rank, Gamma curve B | 400 | 100% |
| | 370 | 80% |
| | 320 | 60% |
| | 240 | 40% |
| third rank, Gamma curve C | 150 | 100% |
| | 130 | 80% |
| | 100 | 60% |
| | 50 | 40% |

For example, as shown in Table 1, which shows the correlation between the brightness and the duty ratio corresponding to the Gamma curve in each rank.

The correlation between the brightness and the duty ratio can be illustrated in other manners in addition to the above-mentioned manner. For example, in each rank, a simulation curve of the brightness and the duty ratio is drawn, and an equation of the brightness and the duty ratio can be obtained based on the curve, and then the correlation between the brightness and the duty ratio can be illustrated by the equation.

Figure 5:
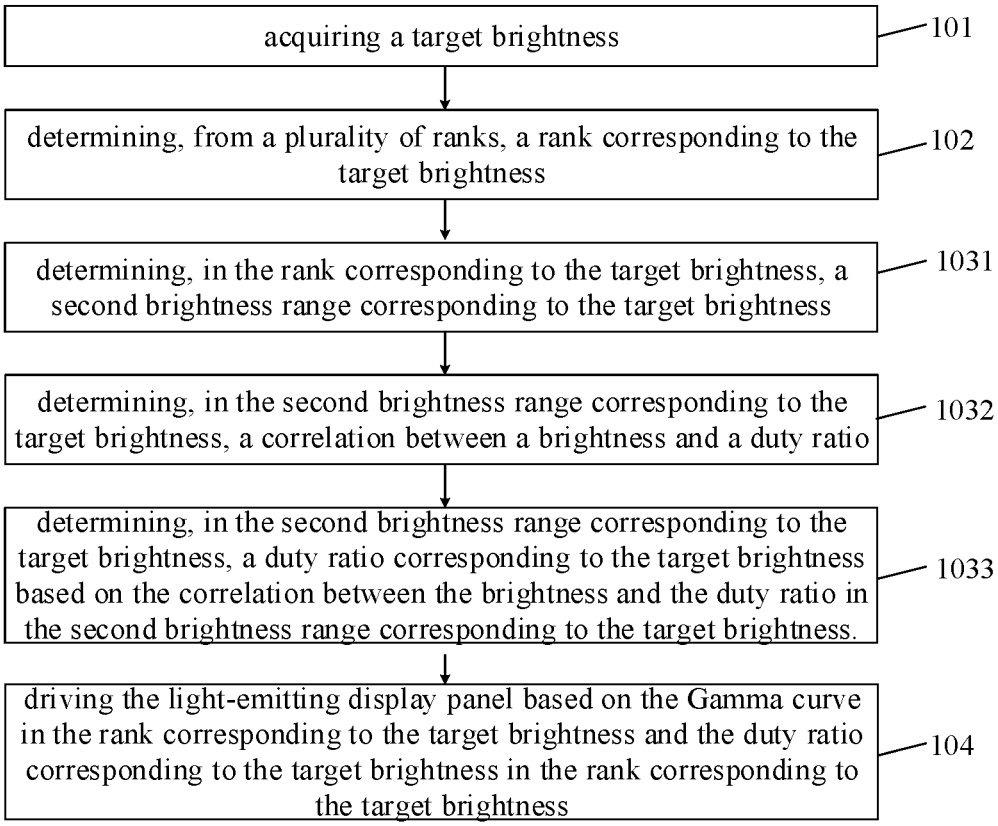
FIG. 5 is a flowchart of another driving method for an organic light-emitting display panel according to an embodiment of the present disclosure.

In an embodiment, the first brightness range H1 of each rank is divided into a plurality of second brightness ranges H2, and different second brightness ranges H2 in a same first brightness range H1 have no overlapping. For example, in the first rank, the first brightness range H1 (400, 600] is divided into four second brightness intervals H2: (400, 450], (450, 520], (520, 580], and (580, 600]. In the second rank, the first brightness range H1 (150,400] is divided into four second brightness ranges H2: (150, 240], (240, 320], (320, 370], and (370, 400]. In the third rank, the first brightness range H1 (0, 150] is divided into four second brightness ranges H2: (0, 50], (50, 100], (100, 130], and (130, 150]. As shown in FIG. 5, which is a flowchart of another driving method for an organic light-emitting display panel according to an embodiment of the present disclosure, the step 103 of determining, according to the preset correlation between the duty ratio and the brightness, a duty ratio corresponding to the target brightness in the rank corresponding to the target brightness includes following steps.

Step 1031: a second brightness range corresponding to the target brightness is determined in a rank corresponding to the target brightness.

In one embodiment, for example, the target brightness is 500 nits, and it corresponds to the second brightness range (450, 520] in the first rank.

Step 1032: a correlation between a brightness and a duty ratio in the second brightness range corresponding to the target brightness is determined.

In one embodiment, for example, a correlation between a brightness and a duty ratio in each second brightness range H2 is set in advance, and the correlation between the brightness and the duty ratio in the second brightness range H2 (450, 520] is determined.

Step 1033: in the second brightness range corresponding to the target brightness, a duty ratio corresponding to the target brightness is determined based on the correlation between the brightness and the duty ratio in the second brightness range corresponding to the target brightness.

The process of step 1031 to step 1033 can further determine a corresponding duty ratio according to the target brightness in the second brightness range H2, so that when the target brightness is between different nodes, the duty ratio can be more accurately determined, and thus the transition effect of brightness adjustment between different nodes can be improved.

In an embodiment, the correlation between the brightness and the duty ratio in the second brightness range corresponding to the target brightness satisfies the following formula:

$$\frac{D-D2}{L-L2}=\frac{D1-D2}{L1-L2}$$

In the above formula, D is the duty ratio corresponding to the target brightness, L is the target brightness, D1 is the duty ratio corresponding to the maximum brightness of the second brightness range corresponding to the target brightness, D2 is the duty ratio corresponding to the minimum brightness of the second brightness range corresponding to the target brightness, L1 is the maximum brightness of the second brightness range corresponding to the target brightness, and L2 is the minimum brightness of the second brightness range corresponding to the target brightness.

For example, the brightness and the duty ratio corresponding to the maximum brightness of each second brightness range H2 are set in advance, and the brightness and the duty ratio corresponding to the minimum brightness of each second brightness range H2 are set in advance, that is, a correlation between each brightness and duty ratio shown in Table 1 is set in advance. If the target brightness is the brightness in Table 1, the corresponding duty ratio can be directly selected. If the target brightness is a brightness other than that in Table 1, the duty ratio corresponding to the target brightness can be obtained according to the above formula. For example, the target brightness L=500 nits, which is within a range from 520 nits to 450 nits, then D1=60%, D2=40%, L1=520 nits, L2=450 nits, and the duty ratio corresponding to the target brightness can be obtained according to the above formula:

$$\frac{D-40\%}{500-450}=\frac{60\%-40\%}{520-450},\ D\approx 54\%.$$

In an embodiment, for all second brightness ranges H2 of each rank, the difference between the maximum duty ratio and the minimum duty ratio has a same value. For example, as shown in Table 1, in each rank, for each second brightness range H2, the difference between the maximum duty ratio and the minimum duty ratio is 20%. The duty ratio corresponding to the maximum brightness and the duty ratio corresponding to the minimum brightness in each second brightness range H2 are obtained by pre-testing and the adjustment effect is the best, and the duty ratio corresponding to other brightness is obtained by the above formula and thus only a duty ratio that is close to the duty ratio corresponding to the target brightness can be obtained. Therefore, with the above setting manner in which the difference between the maximum duty ratio and the minimum duty ratio has a same value for all second brightness ranges H2, i.e., the second brightness ranges H2 are arranged more uniformly, the adjustment of the duty ratio is closer to the actual testing result in a same rank.

In an embodiment, the maximum brightness of the first brightness range H1 in each rank corresponds to a duty ratio of 100%. With this arrangement, the characteristic of the display panel itself can be more fully utilized, so that the display panel works within a larger brightness range.

Figure 6:
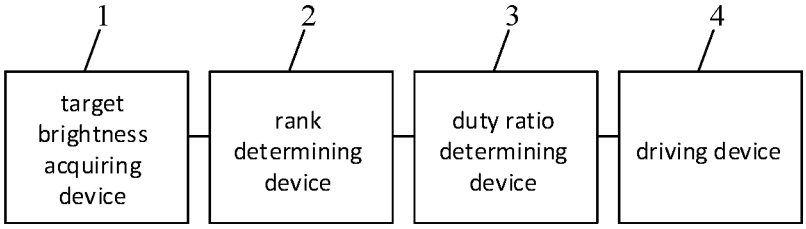
FIG. 6 is a structural block diagram of a driving chip for an organic light-emitting display panel according to an embodiment of the present disclosure.

FIG. 6 is a structural block diagram of a driving chip for an organic light-emitting display panel according to an embodiment of the present disclosure. As shown in FIG. 6, an embodiment of the present disclosure further provides a driving chip for an organic light-emitting display panel. The driving chip includes: a target brightness acquiring device 1, a rank determining device 2, a duty ratio determining device 3, and a driving device. The target brightness acquiring device 1 is configured to acquire a target brightness. The rank determining device 2 is configured to determine a rank corresponding to the target brightness from a plurality of ranks, and each rank includes a first brightness range. Different ranks have different first brightness ranges and have no overlapping. The first brightness range in the rank corresponding to the target brightness includes the target brightness. Each rank has a Gamma curve corresponding to the maximum brightness of the first brightness range in this rank. The duty ratio determining device 3 is configured to determine a duty ratio corresponding to the target brightness in the rank corresponding to the target brightness, where the duty ratio is an effective pulse duty ratio of a light-emitting control signal, and the maximum brightness of the first brightness range in each rank corresponds to a same duty ratio. The driving device 4 is configured to drive an organic light-emitting display panel based on the Gamma curve in the rank corresponding to the target brightness and the duty ratio corresponding to the target brightness in the rank corresponding to the target brightness.

The driving method and principle of the driving chip are the same as those described in the above embodiments, and the details are not further described herein.

Figure 7:
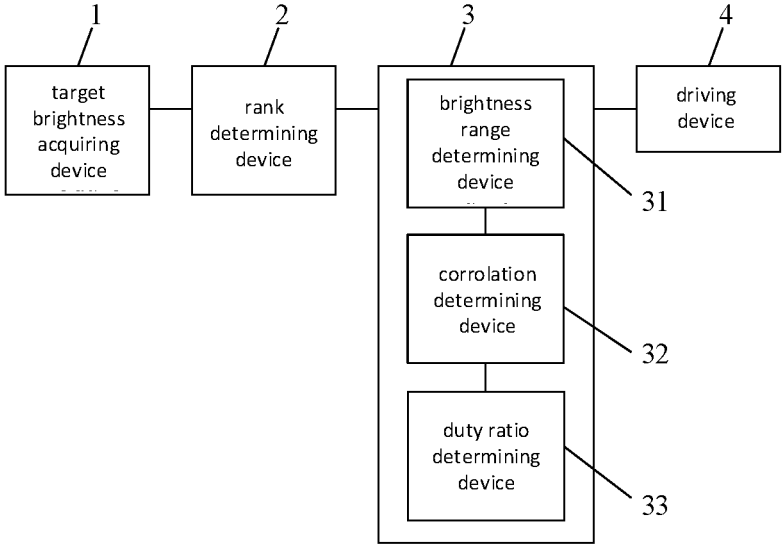
FIG. 7 is a structural block diagram of another driving chip for an organic light-emitting display panel according to an embodiment of the present disclosure.

The driving chip for the organic light-emitting display panel in this embodiment of the present disclosure is driven based on the Gamma curve in the rank corresponding to the target brightness. That is, based on the target brightness, different Gamma curves are selected during a wide range of brightness adjustment, and the brightness is adjusted by adjusting a corresponding data voltage value, and then the brightness is finely adjusted by adjusting the duty ratio within a small range of variation based on the selected Gamma curve. On the one hand, the image can be closer to the Gamma curve when the brightness is adjusted within a large range of variation; and on the other hand, the brightness is finely adjusted by adjusting the duty ratio based on the selected Gamma curve, so that the transition effect of brightness adjustment between different Gamma curves can be improved In an embodiment, the duty ratio determining device 3 is configured to determine, according to a preset correlation between the duty ratio and the brightness, a duty ratio corresponding to the target brightness in the rank corresponding to the target brightness In an embodiment, the first brightness range in each rank is divided into a plurality of second brightness ranges, and different second brightness ranges in a same first brightness range have no overlapping. FIG. 7 is a structural block diagram of another driving chip for an organic light-emitting display panel according to an embodiment of the present disclosure. As shown in FIG. 7, the duty ratio determining device 3 includes: a brightness range determining device 31, a correlation determining device 32, and a duty ratio determining device 33. The brightness range determining device 31 is configured to determine, in the rank corresponding to the target brightness, a second brightness range corresponding to the target brightness. The correlation determining device 32 is configured to determine a correlation between the brightness and the duty ratio in the second brightness range corresponding to the target brightness. The duty ratio determining device 33 is configured to determine, in the second brightness range corresponding to the target brightness, a duty ratio corresponding to the target brightness according to the correlation between the brightness and the duty ratio in the second brightness range corresponding to the target brightness.

In an embodiment, the correlation between the brightness and the duty ratio in the second brightness range corresponding to the target brightness satisfies the following formula:

$$D = L \times \frac{D1 - D2}{L1 - L2}$$

In the above formula, D is the duty ratio corresponding to the target brightness, L is the target brightness, D1 is the duty ratio corresponding to the maximum brightness of the second brightness range corresponding to the target brightness, D2 is the duty ratio corresponding to the minimum brightness of the second brightness range corresponding to the target brightness, L1 is the maximum brightness of the second brightness range corresponding to the target brightness, and L2 is the minimum brightness of the second brightness range corresponding to the target brightness.

In an embodiment, for all second brightness ranges H2 of each rank, the difference between the maximum duty ratio and the minimum duty ratio has a same value.

In an embodiment, the maximum brightness of the first brightness range in each rank corresponds to a duty ratio of 100%.

Figure 8:
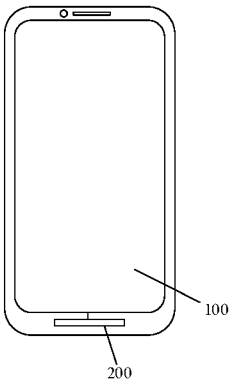
FIG. 8 is a schematic structural diagram of a display device according to an embodiment of the present disclosure.

FIG. 8 is a schematic structural diagram of a display device according to an embodiment of the present disclosure. As shown in FIG. 8, the display device includes an organic light-emitting display panel 100 and the abovementioned driving chip.

The structure and principle of the organic light-emitting display panel 100 are the same as those described in the above embodiments, and the details are not further described herein. The display device may be any electronic device having a display function, such as a touch display screen, a cellphone, a tablet computer, a laptop computer, an electronic paper book, or a television.

The driving chip for the organic light-emitting display panel in this embodiment of the present disclosure is driven based on the Gamma curve in the rank corresponding to the target brightness. That is, based on the target brightness, different Gamma curves are selected during a wide range of brightness adjustment, and the brightness is adjusted by adjusting a corresponding data voltage value, and then the brightness is finely adjusted by adjusting the duty ratio within a small range of variation based on the selected Gamma curve. On the one hand, the image can be closer to the Gamma curve when the brightness is adjusted within a large range of variation; and on the other hand, the brightness is finely adjusted by adjusting the duty ratio based on the selected Gamma curve, so that the transition effect of brightness adjustment between different Gamma curves can be improved

What is claimed is:

1. A driving method for an organic light-emitting display panel, comprising:

presetting a correlation between a duty ratio and a brightness;

acquiring a target brightness, wherein the target brightness defines a brightness range as set by a user of the organic light-emitting display panel;

determining a rank, from a plurality of ranks, corresponding to the target brightness, wherein each of the plurality of ranks comprises a first brightness range, and the first brightness ranges of any two ranks of the plurality of ranks are different from each other and have no overlapping, the first brightness range of the rank corresponding to the target brightness comprises the target brightness, and each of the plurality of ranks has a Gamma curve corresponding to a maximum brightness of the first brightness range of the rank, determining, in the rank corresponding to the target brightness, a duty ratio corresponding to the target brightness, wherein the duty ratio is an effective pulse duty ratio of a light-emitting control signal, and the maximum brightness of the first brightness range of each of the plurality of ranks corresponds to a same duty ratio, adjusting the duty ratio from 100% to 0% according to data voltage values based on the maximum brightness of different Gamma curves, and recording the correlation between the brightness and the duty ratio; and adjusting brightness of the organic light-emitting display panel by selecting one of the Gamma curves, by varying the data voltage values, and by varying the duty ratio corresponding to the target brightness in the rank corresponding to the target brightness according to the selected Gamma curve.

2. The driving method for the organic light-emitting display panel according to claim 1, wherein said determining, in the rank corresponding to the target brightness, a duty ratio corresponding to the target brightness comprises: determining, in the rank corresponding to the target brightness, a duty ratio corresponding to the target brightness according to the preset correlation between a duty ratio and a brightness.

3. The driving method for the organic light-emitting display panel according to claim 2, wherein the first brightness range of each of the plurality of ranks is divided into a plurality of second brightness ranges, any two second brightness ranges of the plurality of second brightness ranges in a same first brightness range having no overlapping;

wherein said determining, in the rank corresponding to the target brightness, a duty ratio corresponding to the target brightness according to the preset correlation between a duty ratio and a brightness comprises:

determining, in the rank corresponding to the target brightness, a second brightness range corresponding to the target brightness from the plurality of second brightness ranges;

determining a correlation between a brightness and a duty ratio in the second brightness range corresponding to the target brightness; and determining, in the second brightness range corresponding to the target brightness, a duty ratio corresponding to the target brightness based on the correlation between the brightness and the duty ratio in the second brightness range corresponding to the target brightness.

4. The driving method for the organic light-emitting display panel according to claim 3, wherein the correlation between the brightness and the duty ratio in the second brightness range corresponding to the target brightness satisfies a formula of:

$$\frac{D-D2}{L-L2}=\frac{D1-D2}{L1-L2},$$

wherein D is the duty ratio corresponding to the target brightness, L is the target brightness, D1 is a duty ratio corresponding to a maximum brightness of the second brightness range corresponding to the target brightness, D2 is a duty ratio corresponding to a minimum brightness of the second brightness range corresponding to the target brightness, L1 is the maximum brightness of the second brightness range corresponding to the target brightness, and L2 is the minimum brightness of the second brightness range corresponding to the target brightness.

5. The driving method for the organic light-emitting display panel according to claim 4, wherein for the plurality of second brightness ranges of each of the plurality of ranks, a difference between a maximum duty ratio and a minimum duty ratio has a same value.

6. The driving method for the organic light-emitting display panel according to claim 1, wherein the maximum brightness of the first brightness range of each of the plurality of ranks corresponds to a duty ratio of 100%.

7. A display device, comprising:

an organic light-emitting display panel; and a driving chip for an organic light-emitting display panel which is configured to cause the display device to:

preset a correlation between a duty ratio and a brightness;

acquire a target brightness, wherein the target brightness defines a brightness range as set by a user of the organic light-emitting display panel;

determine a rank corresponding to the target brightness from a plurality of ranks, wherein each of the plurality of ranks comprises a first brightness range, the first brightness ranges of any two ranks of the plurality of ranks are different from each other and have no overlapping, the first brightness range of the rank corresponding to the target brightness comprises the target brightness, each of the plurality of ranks has a Gamma curve corresponding to a maximum brightness of the first brightness range of the rank;

determine a duty ratio corresponding to the target brightness in the rank corresponding to the target brightness, wherein the duty ratio is an effective pulse duty ratio of a light-emitting control signal, and the maximum brightness of the first brightness range in each of the plurality of ranks corresponds to a same duty ratio, the processor is further caused to adjust the duty ratio from 100% to 0% according to data voltage values based on the maximum brightness of different Gamma curves, and record the correlation between the brightness and the duty ratio; and adjusting brightness of the organic light-emitting display panel by selecting one of the Gamma curves, by varying the data voltage values, and by varying the duty ratio corresponding to the target brightness in the rank corresponding to the target brightness according to the selected Gamma curve.

8. A driving chip for an organic light-emitting display panel, comprising:

a target brightness acquiring circuit configured to acquire a target brightness, wherein the target brightness defines a brightness range as set by a user of the organic light-emitting display panel;

a rank determining circuit configured to determine a rank corresponding to the target brightness from a plurality of ranks, wherein each of the plurality of ranks comprises a first brightness range, the first brightness ranges of any two ranks of the plurality of ranks are different from each other and have no overlapping, the first brightness range of the rank corresponding to the target brightness comprises the target brightness, each of the plurality of ranks has a Gamma curve corresponding to a maximum brightness of the first brightness range of the rank;

a duty ratio determining circuit configured to determine a duty ratio corresponding to the target brightness in the rank corresponding to the target brightness, wherein the duty ratio is an effective pulse duty ratio of a light-emitting control signal, and the maximum brightness of the first brightness range in each of the plurality of ranks corresponds to a same duty ratio; and a driving circuit configured to adjust brightness of the organic light-emitting display panel by selecting one of the Gamma curves, by varying the data voltage values, and by varying the duty ratio corresponding to the target brightness in the rank corresponding to the target brightness according to the selected Gamma curve.

9. The driving chip for the organic light-emitting display panel according to claim 8, wherein the processor is configured to determine, in the rank corresponding to the target brightness, a duty ratio corresponding to the target brightness according to the preset correlation between a duty ratio and a brightness.

10. The driving chip for the organic light-emitting display panel according to claim 9, wherein the first brightness range of each of the plurality of ranks is divided into a plurality of second brightness ranges, and any two second brightness ranges of the plurality of second brightness ranges in a same first brightness range have no overlapping;

the processor is further caused to:

determine, in the rank corresponding to the target brightness, a second brightness range corresponding to the target brightness;

determine a correlation between a brightness and a duty ratio in the second brightness range corresponding to the target brightness; and determine, in the second brightness range corresponding to the target brightness, a duty ratio corresponding to the target brightness according to the correlation between the brightness and the duty ratio in the second brightness range corresponding to the target brightness.

11. The driving chip for the organic light-emitting display panel according to claim 10, wherein the correlation between the brightness and the duty ratio in the second brightness range corresponding to the target brightness satisfies a formula of:

$$\frac{D-D2}{L-L2}=\frac{D1-D2}{L1-L2},$$

wherein D is the duty ratio corresponding to the target brightness, L is the target brightness, D1 is a duty ratio corresponding to a maximum brightness of the second brightness range corresponding to the target brightness, D2 is a duty ratio corresponding to a minimum brightness of the second brightness range corresponding to the target brightness, L1 is the maximum brightness of the second brightness range corresponding to the target brightness, and L2 is the minimum brightness of the second brightness range corresponding to the target brightness.

12. The driving chip for the organic light-emitting display panel according to claim 11, wherein for the plurality of second brightness ranges of each of the plurality of ranks, a difference between a maximum duty ratio and a minimum duty ratio has a same value.

13. The driving chip for the organic light-emitting display panel according to claim 8, wherein the maximum brightness of the first brightness range of each of the plurality of ranks corresponds to a duty ratio of 100%.

* * * * *